US006973164B2

(12) United States Patent
Hartlove et al.

(10) Patent No.: US 6,973,164 B2
(45) Date of Patent: Dec. 6, 2005

(54) LASER-PRODUCED PLASMA EUV LIGHT SOURCE WITH PRE-PULSE ENHANCEMENT

(75) Inventors: Jeffrey S. Hartlove, Rolling Hills Estates, CA (US); Mark E. Michaelian, Lomita, CA (US); Henry Shields, San Pedro, CA (US); Samuel Talmadge, Agoura Hills, CA (US); Steven W. Fornaca, Torrance, CA (US); Armando Martos, Chesterfield, MO (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 134 days.

(21) Appl. No.: 10/606,854

(22) Filed: Jun. 26, 2003

(65) Prior Publication Data

US 2004/0264512 A1 Dec. 30, 2004

(51) Int. Cl.[7] ..... H01J 35/00
(52) U.S. Cl. ..... 378/119; 372/5
(58) Field of Search ..... 372/5, 8, 9, 29, 372/516, 3, 76, 70, 56; 378/119, 145, 143

(56) References Cited

U.S. PATENT DOCUMENTS

| | | | | |
|---|---|---|---|---|
| 4,399,539 | A * | 8/1983 | White | 372/3 |
| 4,704,718 | A * | 11/1987 | Suckewer | 372/5 |
| 6,504,903 | B1 * | 1/2003 | Kondo et al. | 378/119 |
| 6,831,963 | B2 * | 12/2004 | Richardson | 378/119 |

OTHER PUBLICATIONS

Prepulse enhanced EUV yield from a xenon gasjet laser produced plasma□□G Kooijman, R de Bruijny K Koslelev*, F Bijkerk, Lasers for Science Facility Programme—Physics, Central Laser Facility Annual Report 2001/2002,□□p. 142-144.*

Ultraviolet prepulse for enhanced x-ray emission and brightness form droplet-target laser plasmas□□M. Berglund,a) L. Rymell, and H. M. Hertz, Appl. Phys. Lett, vol. 69, N. 12, Sep. 16, 1996, p1683-1985.*

Enhancement of key x-ray emission in laser-produced plasmas by a weak prepulse laser, R. Kodama, T. Mochizuki. K. A. Tanaka, and C. Yamanaka, Appl. Phys. Lett, vol. 50, N. 12, Mar. 23, 1987, p720-722.*

Kooijman, G.; Brujn, R de; Koshelev, K.; Bijkerk, F.; Shaikh, W.; Bodey, A.J.; and Hirst, G.; Prepulse enhanced EUV yield form a xenon gas-jet laser produced plasma; Central Laser Facility Annual Report 2001/2002, Lasers for Science Faclity Programme—Physics; pps. 142-144.

(Continued)

*Primary Examiner*—Minsun O. Harvey
*Assistant Examiner*—Tuan N. Nguyen
(74) *Attorney, Agent, or Firm*—John A. Miller; Warn, Hoffmann, Miller & LaLone, P.C.

(57) ABSTRACT

An EUV radiation source that employs a low energy laser pre-pulse and a high energy laser main pulse. The pre-pulse generates a weak plasma in the target area that improves laser absorption of the main laser pulse to improve EUV radiation emissions. High energy ion flux is reduced by collisions in the localized target vapor cloud generated by the pre-pulse. Also, the low energy pre-pulse arrives at the target area 20–200 ns before the main pulse for maximum output intensity. The timing between the pre-pulse and the main pulse can be reduced below 160 ns to provide a lower intensity of the EUV radiation. In one embodiment, the pre-pulse is split from the main pulse by a suitable beam splitter having the proper beam intensity ratio, and the main pulse is delayed to arrive at the target area after the pre-pulse.

24 Claims, 2 Drawing Sheets

OTHER PUBLICATIONS

Berglund, M., Rymell, L. and Hertz, H.M.; Ultraviolet prepulse for enhanced x-ray emission and brightness from droplet-target laser plasmas; 1996 American Institute of Physics, vol. 69, No. 12, Sep. 16, 1997.

Kodama, R., Mochizuki, T., Tanaka, K.A. and Yamanaka, C.; Enhancement of keV x-ray emission in laser-produced plasmas by a weak prepulse laser; 1987 American Institute of Physics, vol. 50, No. 12, Mar. 23, 1987.

* cited by examiner

LASER-PRODUCED PLASMA EUV LIGHT SOURCE WITH PRE-PULSE ENHANCEMENT

BACKGROUND OF THE INVENTION

1. Field of the Invention

This invention relates generally to an extreme ultraviolet (EUV) radiation source and, more particularly, to a laser-plasma EUV radiation source that employs a low energy laser pre-pulse immediately preceding a high energy laser main pulse to improve the conversion of laser power to EUV radiation.

2. Discussion of the Related Art

Microelectronic integrated circuits are typically patterned on a substrate by a photolithography process, well known to those skilled in the art, where the circuit elements are defined by a light beam propagating through a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths. In other words, the resolution of the photolithography process increases as the wavelength of the light source decreases to allow smaller integrated circuit elements to be defined. The current trend for photolithography light sources is to develop a system that generates light in the extreme ultraviolet (EUV) or soft X-ray wavelengths (13–14 nm).

Various devices are known in the art to generate EUV radiation. One of the most popular EUV radiation sources is a laser-plasma, gas condensation source that uses a gas, typically xenon, as a laser plasma target material. Other gases, such as argon and krypton, and combinations of gases, are also known for the laser target material. In the known EUV radiation sources based on laser produced plasmas (LPP), the gas is typically cryogenically cooled to a liquid state, and then forced through an orifice or other nozzle opening into a vacuum process chamber as a continuous liquid stream or filament. The liquid target material rapidly freezes in the vacuum environment to become a frozen target stream. Cryogenically cooled target materials, which are gases at room temperature, are desirable because they do not condense on the source optics, and because they produce minimal by-products that have to be evacuated from the process chamber. In some designs, the nozzle is agitated so that the target material emitted from the nozzle forms a stream of liquid droplets having a certain diameter (30–100 $\mu$m) and a predetermined droplet spacing.

The target stream is irradiated by high-power laser beam pulses, typically from an Nd:YAG laser, that heat the target material to produce a high temperature plasma which emits the EUV radiation. The pulse frequency of the laser is application specific and depends on a variety of factors. The laser beam pulses must have a certain intensity at the target area in order to provide enough heat to generate the plasma. Typical pulse durations are 5–30 ns, and a typical pulse intensity is in the range of $5\times10^{10}$–$5\times10^{12}$ W/cm$^2$.

FIG. 1 is a plan view of an EUV radiation source 10 of the type discussed above including a nozzle 12 having a target material storage chamber 14 that stores a suitable target material, such as xenon, under pressure. A heat exchanger or condenser is provided in the chamber 14 that cryogenically cools the target material to a liquid state. The liquid target material is forced through a narrowed throat portion or capillary tube 16 of the nozzle 12 to be emitted under pressure as a filament or stream 18 into a vacuum process chamber 26 towards a target area 20. The liquid target material will quickly freeze in the vacuum environment to form a solid filament of the target material as it propagates towards the target area 20. The vacuum environment in combination with the vapor pressure of the target material will cause the frozen target material to eventually break up into frozen target fragments, depending on the distance that the stream 18 travels and other factors.

A laser beam 22 from a laser source 24 is directed towards the target area 20 in the process chamber 26 to vaporize the target material filament. The heat from the laser beam 22 causes the target material to generate a plasma 30 that radiates EUV radiation 32. The EUV radiation 32 is collected by collector optics 34 and is directed to the circuit (not shown) being patterned, or other system using the EUV radiation 32. The collector optics 34 can have any shape suitable for the purposes of collecting and directing the radiation 32, such as an elliptical shape. In this design, the laser beam 22 propagates through an opening 36 in the collector optics 34, as shown. Other designs can employ other configurations.

In an alternate design, the throat portion 16 can be vibrated by a suitable device, such as a piezoelectric vibrator, to cause the liquid target material being emitted therefrom to form a stream of droplets. The frequency of the agitation and the stream velocity determines the size and spacing of the droplets. If the target stream 18 is a series of droplets, the laser beam 22 may be pulsed to impinge every droplet, or every certain number of droplets.

It is desirable that an EUV radiation source has a good conversion efficiency. Conversion efficiency is a measure of the laser beam energy that is converted into recoverable EUV radiation, i.e., watts of EUV radiation divided by watts of laser power. In order to achieve a good conversion efficiency, the target stream vapor pressure must be minimized because gaseous target material surrounding the stream tends to absorb the EUV radiation. Further, liquid cryogen delivery systems operating near the gas-liquid phase saturation line of the target fluid's phase diagram are typically unable to project a stream of target material significant distances before instabilities in the stream cause it to break up or cause droplets to be formed. Moreover, the distance between the nozzle and the target area must be maximized to keep nozzle heating and condensable source debris to a minimum.

It is known in the laser-produced plasma art to employ a low energy laser pre-pulse that is incident on the target material prior to a high energy laser main pulse, where the main pulse heats the target material and generates the wavelength of light of interest. The pre-pulse is used to improve the absorption of the main pulse. The laser pre-pulse forms a weak plasma, but does not have a high enough intensity to generate the wavelength of light of interest. The known plasma generating systems using pre-pulses have employed suitable optics that allow the pre-pulse and the main pulse to propagate along the same axis as they impinge the target material. Laser produced plasma generation techniques that employ pre-pulses have been shown to increase laser absorption and plasma size, both contributing to enhanced radiation efficiency. However, pre-pulse techniques have not been successfully employed in laser-produced plasma sources that generate EUV radiation.

SUMMARY OF THE INVENTION

In accordance with the teachings of the present invention, an EUV radiation source is disclosed that employs a low energy laser pre-pulse immediately preceding a high energy laser main pulse. The pre-pulse generates a weak plasma in the target area that reduces target density and improves laser absorption of the main laser pulse to increase EUV radiation emissions. The pre-pulse intensity is not great enough to produce efficient EUV radiation emissions. High energy ion flux is reduced by collisions in the localized target vapor cloud generated by the pre-pulse, and thus is less likely to damage source collection optics.

In one embodiment, the low energy pre-pulse arrives at the target area 20–200 ns before the main pulse to provide the maximum EUV radiation generation. The EUV radiation intensity can be controlled by decreasing the time period between the pre-pulse and the main pulse. Also, in one embodiment, the pre-pulse and the main pulse are independent laser beams, separately focused on the target, having an angular separation θ. The angle θ may vary from 0 to 180° to optimize the conversion of the laser energy to EUV radiation emissions. In one embodiment, the pre-pulse and the main pulse may originate from the same laser source. The pre-pulse is split from the main pulse by a suitable beam splitter having the proper beam intensity ratio, and the main pulse is delayed to arrive at the target area after the pre-pulse.

Additional advantages and features of the present invention will become apparent from the following description and appended claims, taken in conjunction with the accompanying drawings.

DETAILED DESCRIPTION OF THE EMBODIMENTS

The following discussion of the embodiments of the present invention directed to an EUV radiation source employing a laser pre-pulse and a laser main pulse is merely exemplary in nature, and is in no way intended to limit the invention or its application or uses. For example, the pre-pulse technique of the invention may be applicable to other radiation source for generating other wavelengths of light other than EUV.

Figure 1:
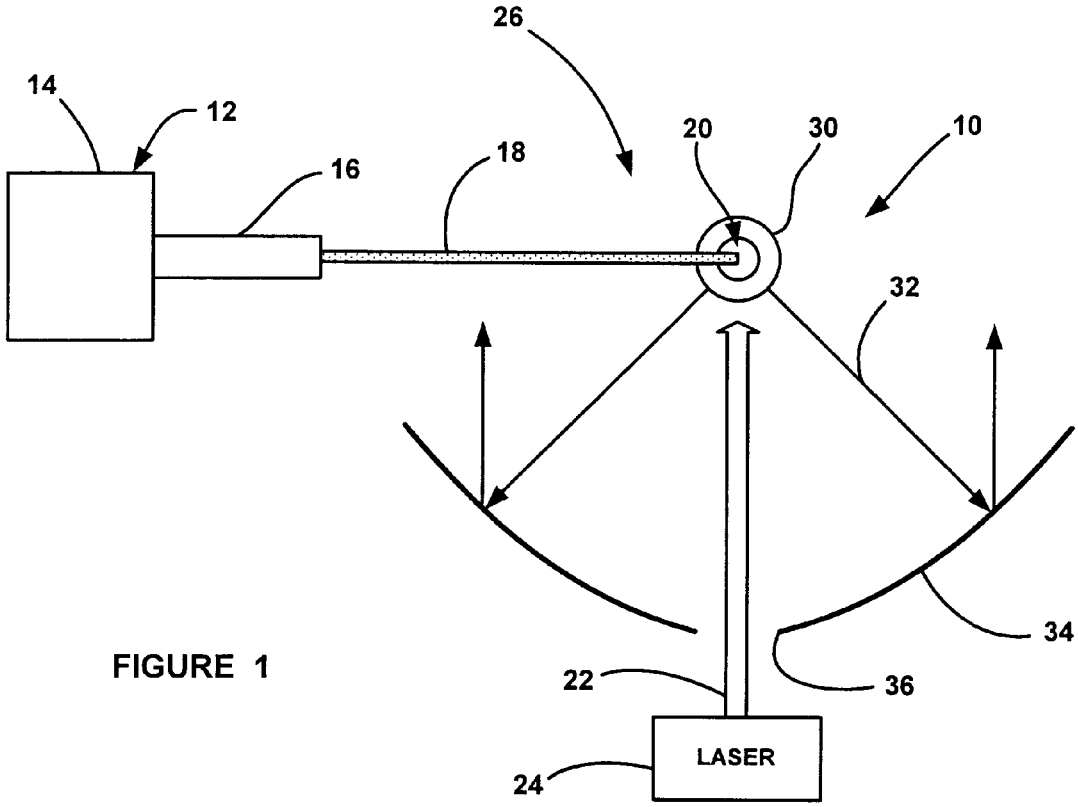
FIG. 1 is a plan view of an EUV radiation source.
Figure 2:
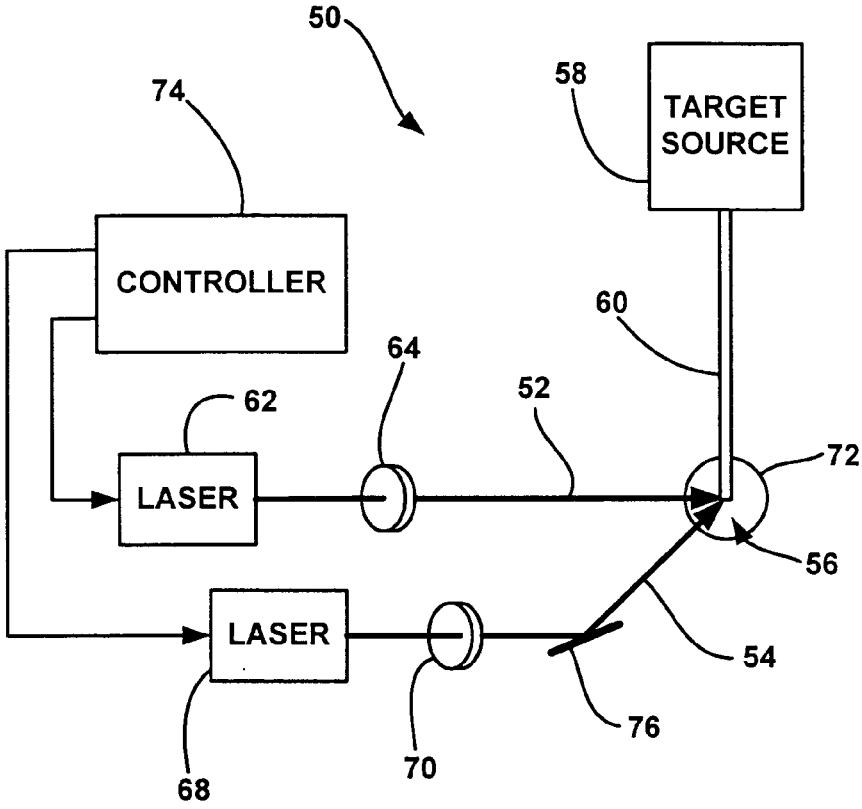
FIG. 2 is a plan view of an EUV radiation source, employing a laser pre-pulse and a laser main pulse, where the laser pulses are generated by separate laser sources, according to an embodiment of the present invention.

FIG. 2 is a plan view of an EUV radiation source 50, according to an embodiment of the present invention. As will be discussed in detail below, the EUV radiation source 50 employs a laser pre-pulse beam 52 and a laser main pulse beam 54 that are directed towards a target area 56. In one embodiment, the durations of the pre-pulse beam 52 and the main pulse beam 54 are within the range of 5–30 ns. However, this is by way of a non-limiting example in that any pulse duration suitable for the purposes described herein can be employed. As discussed above, a stream 60 of a target material, such as xenon, is directed towards the target area 56 from a suitable device 58 to be vaporized and generate the EUV radiation. The target stream 60 can be a frozen target filament having a diameter of 20–100 μm, or any other target suitable for EUV radiation generation, such as a target sheet, target droplets, multiple filaments, etc. The pre-pulse beam 52 is generated by a laser source 62, such as an Nd:YAG laser, and is focused by a lens 64 onto the target area 56. Likewise, the main pulse beam 54 is generated by a laser source 68 and focused by a lens 70 onto the target area 56.

The pre-pulse beam 52 generates a weak plasma 72 in the target area 56 that improves laser absorption of the main pulse beam 54 to increase EUV radiation emissions. In other words, the pre-pulse beam 52 creates a weakly ionized plasma in the target area 56 that expands from the laser beam focus to provide a preconditioned target that more efficiently absorbs the main pulse 54. It is believed that the pre-pulse beam 52 reduces the density and pressure at the target area 56 so that the main pulse beam 54 is less likely to be reflected from the dense target material, and more likely to be absorbed within the target material to produce the EUV radiation. The intensity of the pre-pulse beam 52 at the target area 56 is not great enough to produce efficient EUV radiation emissions.

Improved absorption of the main beam 54 leads to higher conversion of beam energy to EUV radiation. It has been shown that using the pre-pulse beam 52 increases the energy of the EUV radiation 20%–30% over those sources that do not employ pre-pulses. Thus, the same amount of EUV radiation can be obtained with smaller laser beam energies, or more EUV radiation can be obtained from the same laser beam energy. The laser power of the combined pre-pulse beam 52 and the main beam 54 is not greater, or not significantly greater, than the power of the single laser beam pulses used in the prior art sources.

In this embodiment, the pre-pulse beam 52 is directed at the target area 56 relative to the main pulse beam 54 by an angle θ. The angle θ can be any angle between 0 and 180° that would optimize the conversion of the main beam pulse 54 to the EUV radiation. The angle θ may be optimized for different applications, such as beam intensities, target materials, etc. Typically, the intensity of the pre-pulse beam 52 will be about 10% of the intensity of the main pulse beam 54. Also, mirrors and the like can be provided to direct the pre-pulse beam 52 and the main pulse beam 54 along the same axis when they impinge the target area 56. In this embodiment, the pre-pulse beam 52 and the main pulse beam 54 may be linearly polarized in different directions by a suitable polarizer and/or wave plate. In one embodiment, the pre-pulse beam 52 has an energy of about 40 mJ and a duration of 10 ns, the main pulse beam 54 has an energy of 700 mJ and a duration of 10 ns, and the angle θ is 30°. In another embodiment, the prepulse beam 52 has an energy of 10–40 mJ, the main pulse beam has an energy of 0.1–1 J, and the angle θ is 90°.

The laser sources 62 and 68 are electrically coupled to a controller 74 that provides pulse initiation and timing for the beams 52 and 54. The controller 74 can be any controller, microprocessor, etc. suitable for the purposes described herein. As discussed herein, the pre-pulse beam 52 arrives at the target area 56 just before the main pulse beam 54 to provide the benefits of increased EUV radiation conversion. In one embodiment, this time delay is 20–200 ns. However, this is by way of a non-limiting example in that other delays and time differences may be suitable for other applications. To provide the time delay between the beams 52 and 54, the controller 74 fires the laser 62 first, and then fires the laser 68 the necessary time thereafter.

In this embodiment, the beam 54 is bent by folding optics 76 to provide the desired separation angle θ between the beams 52 and 54. The path length from the laser 62 to the target area 56 is the same as the path length from the laser 68 to the target area 56, and the controller 74 provides the timing control. Alternately, the path length from the laser 62 to the target area 56 can be shorter than the path length from the laser 68 to the target area 56 to provide the timing differential.

Further, it has been shown that the high energy ion flux from the plasma 72 is reduced by collisions in the localized target vapor cloud generated by the pre-pulse beam 52. It is believed that the reduction in high energy ion flux is caused by the less violent reaction with the target material provided by the weekly ionized plasma. This causes a reduction of the yield of highly energetic ions from the plasma 72. These ions, with energies in the small keV range, typically damage sensitive surfaces of the EUV optical components, resulting in loss of reflectance.

Figure 3:
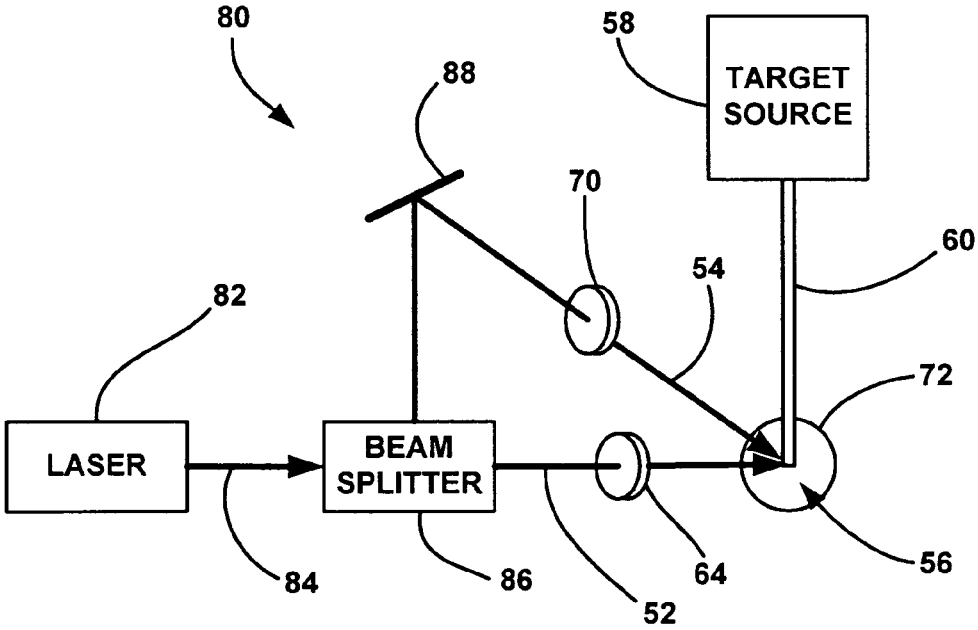
FIG. 3 is a plan view of an EUV radiation source employing a laser pre-pulse and a laser main pulse, where the laser pulses are generated by the same laser source, according to another embodiment of the present invention.

FIG. 3 is a plan view of a portion of an EUV radiation source 80, similar to the radiation source 50, where like elements are represented by like reference numerals. The radiation source 80 also employs the pre-pulse beam 52 and the main pulse beam 54 separated by the angle θ. In this embodiment, the laser sources 62 and 68 have been replaced by a single laser source 82 that generates a single laser pulse beam 84. The beam 84 is split by a beam splitter 86 that provides the pre-pulse beam 52 and the main pulse beam 54. The beam splitter 86 is a well known device that can be designed to select the output intensities of the two beams 52 and 54 to provide the desired beam energies. An example of a suitable beam splitter would be a coated mirror, where the coating provides the proper intensity ratio.

To provide the proper timings, the main pulse beam 54 is delayed by an optical delay device 88 so that it arrives at the target area 56 at the proper time after the pre-pulse beam 52. The optical delay device 88 can be any delay device suitable for the purposes described herein, and will generally be a mirror or series of mirrors that provide a longer path length for the main pulse beam 54 than the path length of the pre-pulse beam 52. In one embodiment, the path length of the main pulse beam 54 is about 20 feet longer than the path length of the pre-pulse beam 52 to provide the proper delay.

As is known in the art, it is sometimes necessary to vary the intensity of the light beam used in photolithography for patterning integrated circuits to precisely control the light dose delivered to the photoresists and masks. For those photolithography systems that employ EUV radiation as the light, it is difficult to vary the EUV radiation output by varying the laser pulse energy that generates the radiation because the laser thermal and optical components are optimized for a specific pulse energy. Deviations from the source design parameters can lead to premature failure of the laser components. Also, methods such as varying the energy input to the laser or insertion of a variable attenuator in the laser beam path to change the EUV radiation intensity are difficult to achieve at the high pulse rates required for volume chip manufacturing. Typically, there is only about 100 microseconds between laser pulses. Therefore, it is desirable to vary the EUV radiation output without varying the drive laser pulse energy.

As discussed above, to achieve a maximum EUV radiation output from the pre-pulse beam 52 and the main pulse beam 54, the delay between the beam pulses should be in the range of 20–200 ns. However, if the time delay between the pre-pulse beam 52 and the main pulse beam 54 is shorter than 160 ns, then the intensity of the EUV radiation beam will be less than the EUV output intensity in proportion thereto. For example, an 80 ns time delay between the beams 52 and 54 gives about a 20% decrease in the intensity of the EUV radiation output, and a 40 ns delay between the beams 52 and 54 gives about a 30% decrease in the EUV radiation intensity for the same output energy per pulse. Therefore, the EUV pulse energy can be tuned within a range of about 60–100% of the maximum radiation output by varying the prepulse laser beam timing, but keeping a constant laser output energy for the pre-pulse beams 52 and the main pulse beam 54. The timing provided by the controller 74 can precisely control the radiation beam output intensity. Accordingly, the amount of EUV radiation intensity delivered to the photolithograph process can be controlled. This greatly relaxes the requirements on pulse-to-pulse stability, and is likely to improve the manufacturing yield in chip production.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An extreme ultraviolet (EUV) radiation source for generating EUV radiation, said source comprising:

a device for generating at least one stream of a target material, said target material being directed towards a target area;

a first laser source generating a pre-pulse laser beam directed towards the target area; and a second laser source generating a main pulse laser beam directed towards the target area, said pre-pulse beam having a lower intensity than the main pulse beam, wherein the first laser and the second laser are timed so that the pre-pulse beam arrives at the target area before the main pulse beam, and wherein the main pulse beam interacts with the target material to generate the EUV radiation, and wherein the main pulse beam and the pre-pulse beam impinge the target area at an angle of 30° or greater between the beams, and wherein the pre-pulse beam has an energy of about 10–40 mJ and the main pulse beam has an energy of about 0.1 to 1 J.

2. The source according to claim 1 wherein the angle is about 90°.

3. The source according to claim 1 wherein the pre-pulse beam arrives at the target area in the range of 20–200 ns before the main pulse beam.

4. The source according to claim 1 further comprising a controller, said controller controlling the timing between the pre-pulse beam and the main pulse beam so as to control the intensity of the EUV radiation generated by the source.

5. The source according to claim 4 wherein the controller sets the timing between the pre-pulse beam and the main pulse beam to be less than 160 ns to provide a predetermined percentage of the maximum intensity of the EUV radiation.

6. The source according to claim 1 wherein the at least one stream of the target material is selected from the group consisting of a frozen stream, a liquid stream, multiple streams and target droplets.

7. The source according to claim 1 wherein the target material is xenon.

8. The source according to claim 1 wherein the pre-pulse beam has an energy of about 40 mJ and a duration of about 10 ns and the main pulse beam has energy of about 700 mJ and a duration of about 10 ns.

9. An extreme ultraviolet (EUV) radiation source for generating EUV radiation, said source comprising:

a device for generating at least one stream of a target material, said target material being directed towards a target area; and a system for generating a main pulse laser beam and a pre-pulse laser beam, wherein the main pulse beam and the pre-pulse beam are timed so that the pre-pulse beam arrives at the target area before the main pulse beam, and wherein the pre-pulse beam generates a weakly ionized plasma at the target area and the main pulse beam generates the EUV radiation, and wherein the main pulse beam and the pre-pulse beam impinge the target area at an angle of 30° or greater between the beams, and wherein the pre-pulse beam arrives at the target area in the range of 20–200 ns before the main pulse beam.

10. The source according to claim 9 wherein the system includes a first laser source for generating the main pulse laser beam and a second laser source for generating the pre-pulse beam.

11. The source according to claim 9 wherein the system further includes a controller, said controller providing the timing between the main pulse beam and the pre-pulse beam.

12. The source according to claim 11 wherein the controller controls the timing between the pre-pulse beam and the main pulse beam to control the intensity of the EUV radiation generated by the source.

13. The source according to claim 12 wherein the controller sets the timing between the pre-pulse beam and the main pulse beam to be less than 160 ns to provide a predetermined percentage of the maximum intensity of the EUV radiation.

14. The source according to claim 9 wherein the angle is about 90.

15. The source according to claim 9 wherein the pre-pulse beam has an energy of about 10–40 mJ and the main pulse beam has an energy of about 0.1 to 1 J.

16. The source according to claim 9 wherein the at least one stream of the target material is selected from the group consisting of a frozen stream, a liquid stream, multiple streams and target droplets.

17. The source according to claim 9 wherein the pre-pulse beam has an energy of about 40 mJ and a duration of about 10 ns and the main pulse beam has energy of about 700 mJ and a duration of about 10 ns.

18. A method for generating EUV radiation, comprising:

directing a stream or streams of a target material towards a target area;

directing a pre-pulse laser beam towards the target area;

directing a main pulse beam towards the target area, wherein the pre-pulse beam arrives at the target area before the main pulse beam, and wherein the pre-pulse beam generates a weak plasma at the target area and the main pulse beam interacts with the plasma to generate the EUV radiation, and wherein the main pulse beam and the pre-pulse beam impinge the target area at an angle of 30° or greater between the beams; and setting the timing between the pre-pulse beam and the main pulse beam to control the intensity of the EUV radiation, wherein setting the timing includes reducing the time between the pre-pulse beam and the main pulse beam so that the intensity of the EUV radiation is a predetermined amount less than its maximum intensity.

19. The method according to claim 18 wherein the pre-pulse beam arrives at the target area in the range of 20–200 ns before the main pulse beam.

20. The method according to claim 18 wherein directing a stream of a target material includes directing a stream of a target material selected from the group consisting of a frozen stream, a liquid stream, multiple streams and target droplets.

21. The method according to claim 18 wherein the main pulse beam and the pre-pulse beam arrive at the target area separated by an angle of 90°.

22. The method according to claim 18 wherein the pre-pulse beam has an energy of about 40 mJ and a duration of about 10 ns and the main pulse beam has an energy of about 700 mJ and a duration of about 10 ns.

23. An extreme ultraviolet (EUV) radiation source for generating EUV radiation, said source comprising:

a device for generating at least one stream of a target material, said target material being directed towards a target area; and a system for generating a main pulse laser beam and pre-pulse laser beam, wherein the main pulse beam and the pre-pulse beam are timed so that the pre-pulse beam arrives at the target area before the main pulse beam, and wherein the pre-pulse beam generates a weakly ionized plasma target area and the main pulse beam generates the EUV radiation, and wherein the main pulse beam and the pre-pulse beam are separate by an angle of 30° or greater at the target area, and wherein the pre-pulse beam has an energy of about 40 mJ and a duration of about 10 ns and the main pulse beam has an energy of about 700 mJ and a duration of about 10 ms.

24. The source according to claim 23 wherein the at least one stream of the target material is selected from the group consisting of a frozen stream, a liquid stream, multiple streams and target droplets.

* * * * *